US006658904B2

(12) United States Patent
Herbeck et al.

(10) Patent No.: US 6,658,904 B2
(45) Date of Patent: Dec. 9, 2003

(54) PANEL RETENTION MECHANISM FOR AIR HANDLER CABINET

(75) Inventors: Christian C. Herbeck, Manchester, TN (US); Michael W. Austin, McMinnville, TN (US)

(73) Assignee: Carrier Corporation, Farmington, CT (US)

( * ) Notice: Subject to any disclaimer, the term of this patent is extended or adjusted under 35 U.S.C. 154(b) by 208 days.

(21) Appl. No.: 09/904,670

(22) Filed: Jul. 13, 2001

(65) Prior Publication Data

US 2003/0013406 A1 Jan. 16, 2003

(51) Int. Cl.[7] ..... B65D 55/14

(52) U.S. Cl. ..... 70/63; 292/111; 138/149; 52/127.9; 52/584.1; 312/265.5

(58) Field of Search ..... 52/127.5–127.9, 52/582.2, 584; 403/321, 322.1; 70/63, 78, 81, 84; 292/240–242, 95, 98, 101, 111, 194, 202, 114, 214, 217, 218, 226, 228; 285/80; 312/265.5, 265.1; 138/147, 149

(56) References Cited

U.S. PATENT DOCUMENTS

| | | | | | |
|---|---|---|---|---|---|
| 2,180,177 | A | | 11/1939 | Ternstrom | 20/69 |
| 2,647,287 | A | * | 8/1953 | Jones | 292/98 X |
| 3,353,314 | A | * | 11/1967 | Melcher | 52/127.9 |
| 3,567,260 | A | * | 3/1971 | Norris | 52/127.11 |
| 4,076,289 | A | * | 2/1978 | Follows et al. | 292/226 |
| 4,223,500 | A | * | 9/1980 | Clark et al. | 52/309.4 |
| 4,417,430 | A | * | 11/1983 | Loikitz | 52/584 |
| 4,512,122 | A | * | 4/1985 | Berkowitz | 52/127.9 |
| 4,641,468 | A | * | 2/1987 | Slater | 52/309.4 |
| 4,656,795 | A | | 4/1987 | Albrecht et al. | 52/126.6 |
| 4,691,970 | A | * | 9/1987 | Neri | 312/257 SK |
| 5,870,868 | A | | 2/1999 | Kita et al. | 52/309.9 |
| 6,119,427 | A | * | 9/2000 | Wyman | 52/584.1 |
| 6,235,367 | B1 | * | 5/2001 | Holmes et al. | 52/309.4 X |
| 6,497,256 | B1 | * | 12/2002 | Adams et al. | 138/149 |
| 6,530,630 | B2 | * | 3/2003 | Herbeck et al. | 312/265.4 |

FOREIGN PATENT DOCUMENTS

| | | | |
|---|---|---|---|
| DE | 1917949 | | 10/1970 |
| DE | 4422971 | A1 | 1/1994 |
| EP | 0038015 | A2 | 10/1981 |
| GB | 1127308 | | 9/1968 |
| NL | 1014208 | | 7/2001 |
| WO | 01/50068 | A1 | 7/2001 |

* cited by examiner

*Primary Examiner*—Suzanne Dino Barrett
(74) *Attorney, Agent, or Firm*—Wall Marjama & Bilinski LLP

(57) ABSTRACT

An air handling unit (AHU) includes a frame structure and panels that are assembled to provide ducting for handling air. Each panel is rectangular with two sides and four edges. Each edge is integrally formed with the panel by extruding a perimeter of the panel. The extrusion has one flat edge that serves as a receiver for a cammed leg of a latch that is mounted in the same frame structure that retains the panel. While the latches are unengaged, the panel is inserted into the rectangular opening in the structure. The latches are then individually rotated 90 degrees such that the cammed leg pushes the panel further into the pocket, thus compressing a perimeter seal and eliminating air leakage.

10 Claims, 7 Drawing Sheets

PANEL RETENTION MECHANISM FOR AIR HANDLER CABINET

FIELD OF THE INVENTION

This invention relates generally to the field of air handling, and more particularly to a mechanism for retaining panels in an air handler cabinet.

BACKGROUND OF THE INVENTION

Many air handling units in the prior art are simply fabricated from sheet metal ducts that are brought together in the field to establish an enclosed flow path through which air is conducted. The sheet metal walls of the ducts readily conducts heat and provide little in the way of a thermal barrier so that energy flows into or out of the duct work. When the air handling unit is conducting conditioned air, this flow of energy into or out of the duct work is costly and places an unwanted load on the air conditioning equipment.

In addition, when the air handling unit is installed in an unconditioned space and is carrying cooled air, the outer casing of the unit "sweats." The moisture so developed runs off the unit onto the floor or equipment contained in the unconditioned space. This in turn leads to a safety hazard for people working in the area and causes damage to the equipment.

The traditional method for attaching AHU panels to each other is to use mechanical fasteners such as screws that are time consuming to remove and install, prone to getting lost and can strip out. Removal of the panels for equipment installation and maintenance is time consuming and does not allow complete access to the unit's interior. Other similar panel retention designs place the retainer within the panel. If the retainer fails and requires replacement, the entire panel must then be replaced. Placing the retainer within the panel also places the retainer in the inner conditioned air stream, leading to external sweating or the use of expensive composite retainers to avoid sweating.

SUMMARY OF THE INVENTION

Briefly stated, an air handling unit (AHU) includes a frame structure and panels that are assembled to provide ducting for handling air. Each panel is rectangular with two sides and four edges. Each edge is integrally formed with the panel by extruding a perimeter of the panel. The extrusion has one flat edge that serves as a receiver for a cammed leg of a latch that is mounted in the same frame structure that retains the panel. While the latches are unengaged, the panel is inserted into the rectangular opening in the structure. The latches are then individually rotated 90 degrees such that the cammed leg pushes the panel further into the pocket, thus compressing a perimeter seal and eliminating air leakage.

By placing the panels in a freestanding frame and attaching them with quick release latches, the "ease of maintenance" requirement is achieved. The inherent stiffness of foam filled panels also allows for the use of fewer retainers, further shortening the assembly/disassembly process. By placing the retainers in the frame and not the panel, the retainers do not cause a thermal path which leads to exterior sweating. Replacing defective or worn retainers is facilitated in that they are mounted in the easily accessible frame and not in the panel. In addition, the retainer preferably incorporates a cam shape that pushes the panel inward, compressing the perimeter seal as the latch is engaged.

According to an embodiment of the invention, an air handling unit includes a frame structure; at least one panel which fits into a corresponding opening in the frame structure formed by first, second, third, and fourth sides of the frame structure, wherein the first and third sides are substantially parallel and the second and fourth sides are substantially parallel; the panel having first, second, third, and fourth edges, wherein the first and third edges are substantially parallel and the second and fourth edges are substantially parallel; at least the first edge including a pocket formed therein; at least the first side including a latching mechanism therein; the latching mechanism including a rotatable cammed leg, such that when the leg is in a first position, the leg is within the first side, and when the leg is in a second position, the leg extends outside of the first side, such that when the panel is fitted into the frame structure such that the first edge of the panel is adjacent the first side of the frame structure, and the leg is in the second position, the first edge of the panel is latched to the first side of the frame structure.

According to an embodiment of the invention, an air handling unit includes a frame structure; at least one panel which fits into a corresponding opening in the frame structure formed by a plurality of sides of the frame structure; the panel having a plurality of edges corresponding to an equal number of the plurality of sides of the frame structure; at least one of the plurality of edges including a pocket formed therein; and means for latching the at least one of the plurality of sides to the at least one edge containing the pocket, the means for latching being contained within at least one of the plurality of sides of the frame structure.

DETAILED DESCRIPTION OF THE PREFERRED EMBODIMENT

Figure 1:
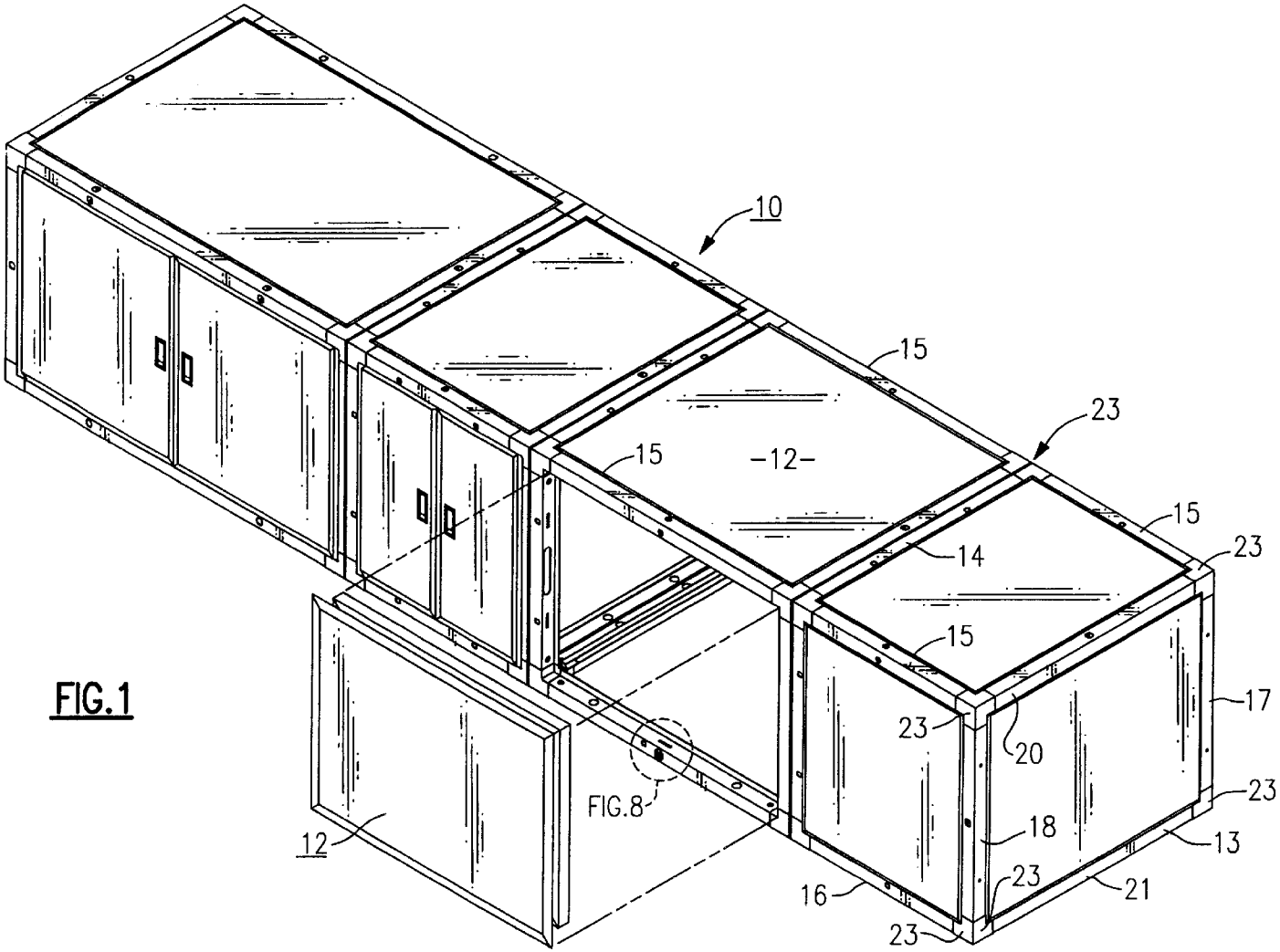
FIG. 1 shows a perspective view of a section of duct work for conducting air along a desired flow path with a panel shown removed from the support frame of the duct work.

Referring to FIG. 1, a section of an air handling unit (AHU) 10 employs a plurality of wall panels 12. AHU 10 includes a series of rectangular shaped modules, each of which has its own structure formed by a pair of end frames 13, 14. Each end frame 13, 14 includes two opposed side rails 17, 18 and an upper rail 20 and a lower rail 21. End frames 13, 14 are connected at the corners by horizontally disposed upper beams 15 and lower beams 16. In assembly, the rails and the beams are slidably retained in corner pieces 23. The rails and the beams in assembly thus establish an open skeleton.

Wall panels 12 are placed in the skeleton openings to close the AHU sections. Each panel is constructed so that it has low thermal conductance, thus greatly impeding the flow of heat into or out of the unit which in turn prevents the unit from sweating.

Figure 2:
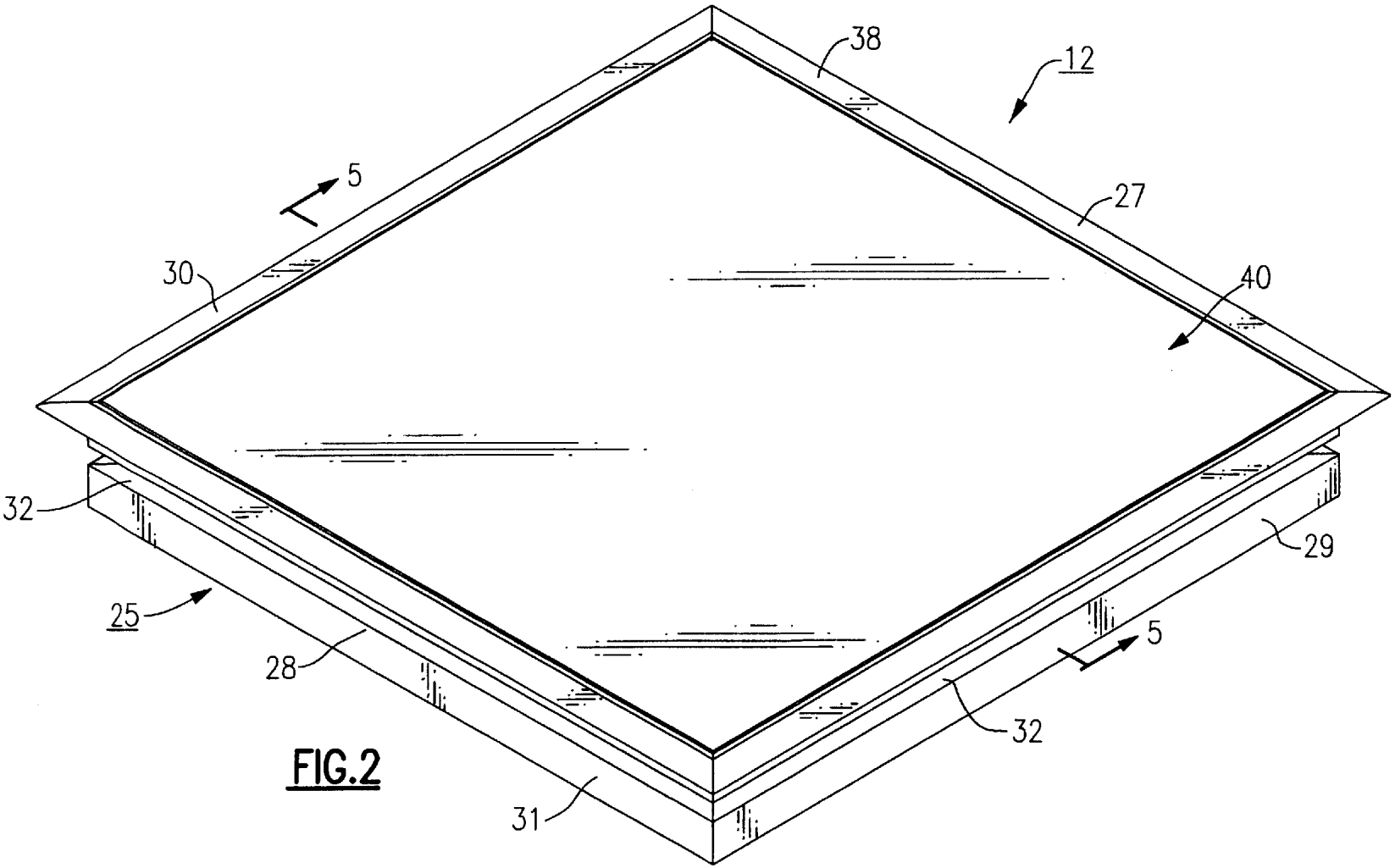
FIG. 2 shows a perspective view of a panel employed to enclose the support frame of the duct work illustrated in FIG. 1.
Figure 3:
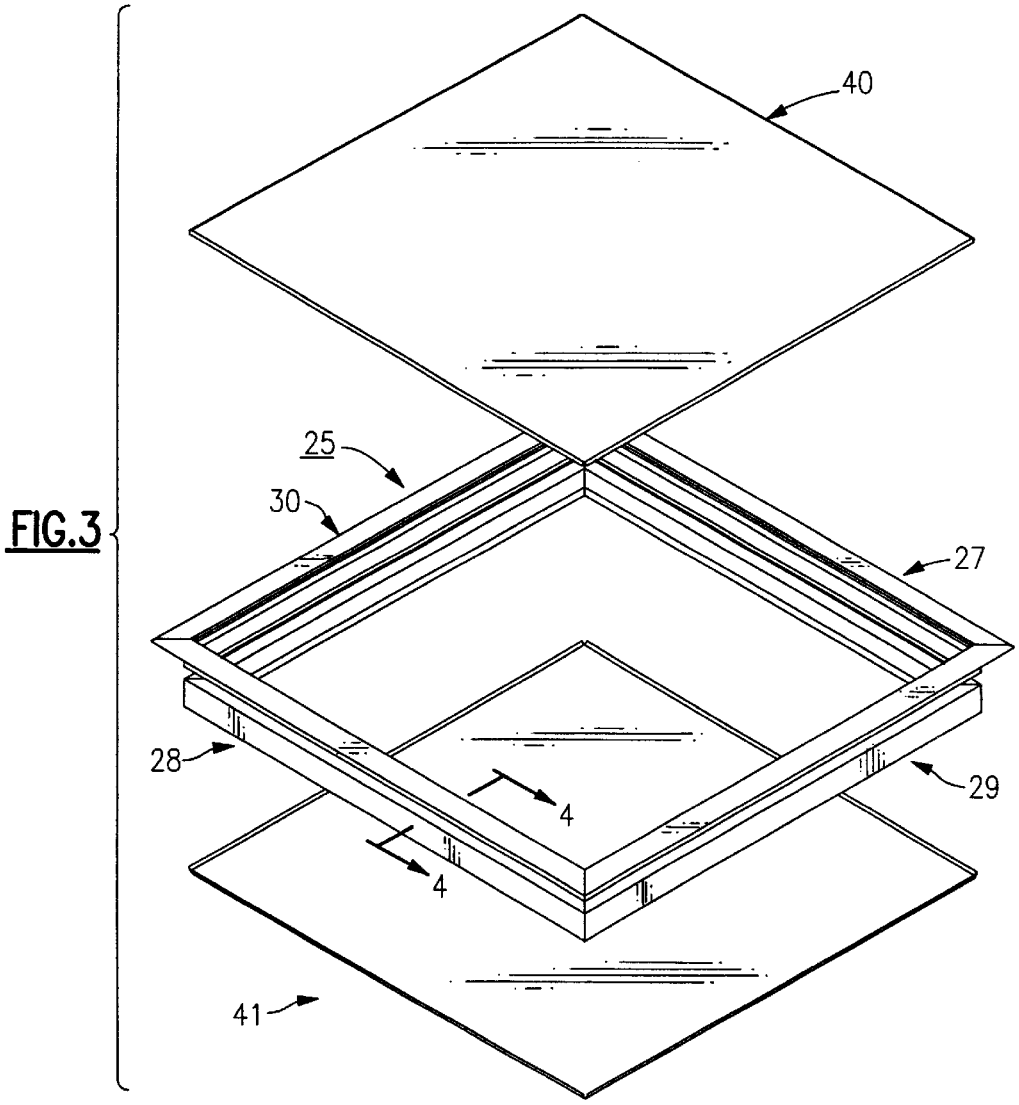
FIG. 3 shows an exploded view illustrating the panel frame and covers.

Referring to FIGS. 2–3, each panel 12 includes a frame 25, preferably rectangular, having a pair of opposed side walls 27 and 28 and a pair of opposed end walls 29 and 30. Each wall preferably contains mitered ends so that the walls can be brought together to form right angle corners. Panel 12 includes a top cover 40 and bottom cover 41 connected by a wall partition 31 having a recess 32 formed centrally therein that preferably extends along the length of the partition. Recess 32 is inwardly disposed with reference to the outer surface of partition 31. Partition 31 is preferably of a plastic having low thermal conductance.

Figure 4:
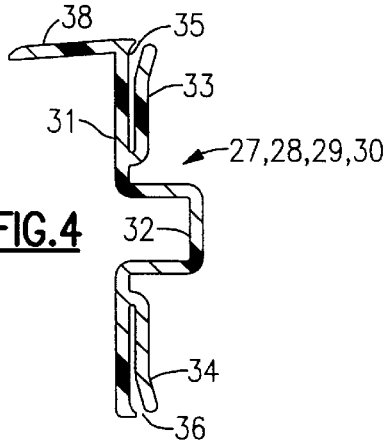
FIG. 4 shows a sectional view of the panel frame taken along line 4—4 in FIG. 3.

Referring to FIG. 4, an upper tab 33 and a lower tab 34 are integrally molded on the inside of partition 31 on either side of recess 32. Tabs 33, 34, like recess 32, preferably extend along the length of the wall. Tabs 33, 34 run parallel to the partition and coact therewith to form channels 35 and 36. Upper channel 35 opens towards the top of the wall while lower channel 36 opens toward the bottom of the wall. A flange 38, which is integral with wall partition 31, runs along the top edge of partition 31. Flange 38 extends outwardly from wall partition 31 to form an angle that is slightly less than 90 degrees with partition 31 so that flange 38 extends downwardly at a slight angle from the top edge of partition 31.

Figure 5:
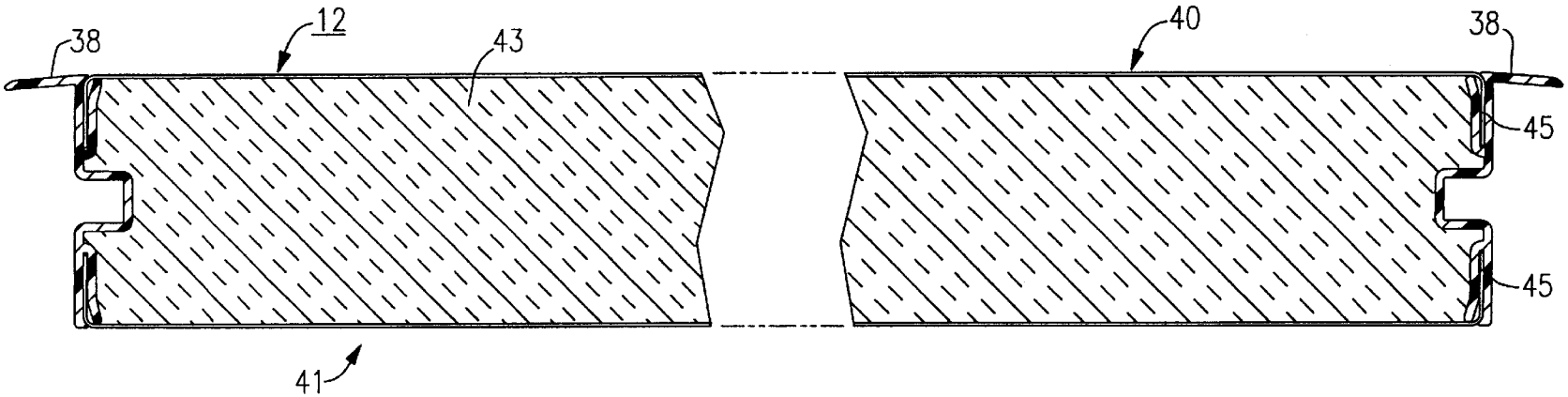
FIG. 5 shows a sectional view of the panel assembly taken along lines 5—5 in FIG. 2.

Referring to FIG. 5, top cover 40 and bottom cover 41 are used to close the frame and create a cavity 43 inside the panel. Each cover 40, 41 is preferably of sheet metal or optionally of a plastic or nylon-reinforced plastic material with a thermal conductivity less than conventional metal ductwork. Each cover 40, 41 contains an inwardly directed skirt 45 that depends downwardly from the cover and extends around the entire periphery of the cover. In assembly, skirts 45 are inserted into upper and lower channels 35, 36 that encircle the panel frame. A curable foam is injected into the cavity to entirely fill the cavity with the foam. When the foam cures, it bonds the frame walls together in abating contact and bonds covers 40, 41 to the frame. The curable foam is preferably a polyurethane foam filler with low thermal conductivity.

Each panel is sized so that the panel frame can be slipped into an opening in one of the unit sections. A close sliding fit is provided between panel frame walls and the side rails and upper and lower beams that form the receiving opening. When the panel is fully received within the opening, flange 38 that surrounds the panel frame is compressed against the outer surfaces of the rails and beams that form the opening.

Figure 6:
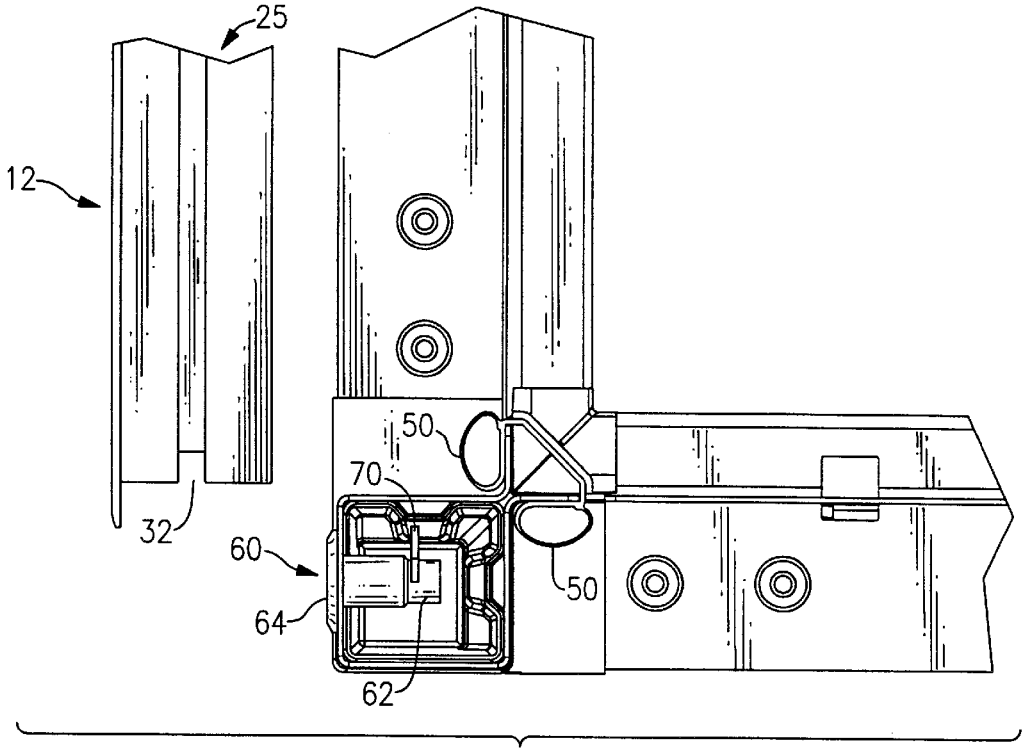
FIG. 6 shows a partial sectional view of a section of the duct work skeleton with one panel removed from the duct work.
Figure 7:
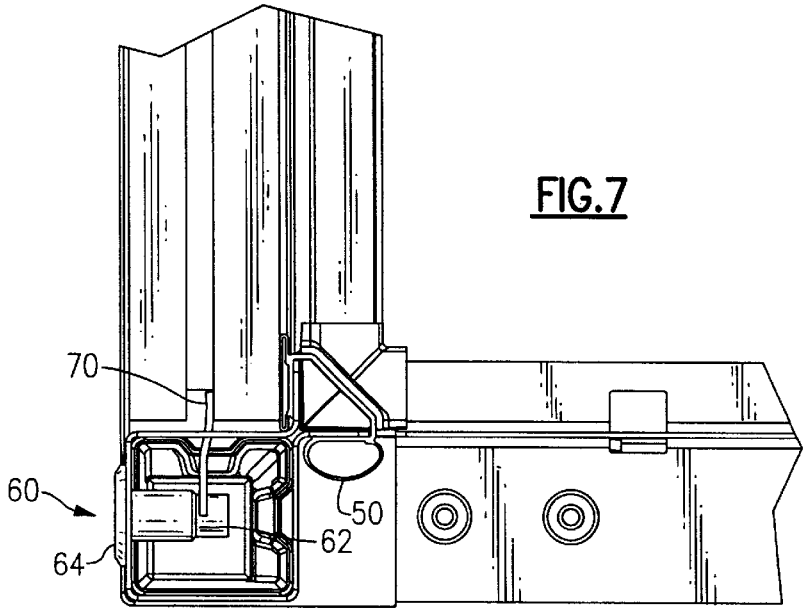
FIG. 7 shows a view similar to FIG. 6 showing the panel locked to the duct work skeleton.

Referring to FIGS. 6–7, a plurality of seals 50, which are preferably compressible and hollow, are mounted around the panel receiving opening. At panel closure, lower cover 41 of panel 12 compresses seal 50 as shown in FIG. 7 to prevent the air being conducted inside the unit from escaping around panel 12. Panels 12 are held in a closed position by a series of latching mechanisms, generally referenced 60, that are mounted inside the rails and the beams surrounding each opening. The rails and the beams are preferably square metal tubes that are slidably retained in corner pieces 23.

Figure 8:
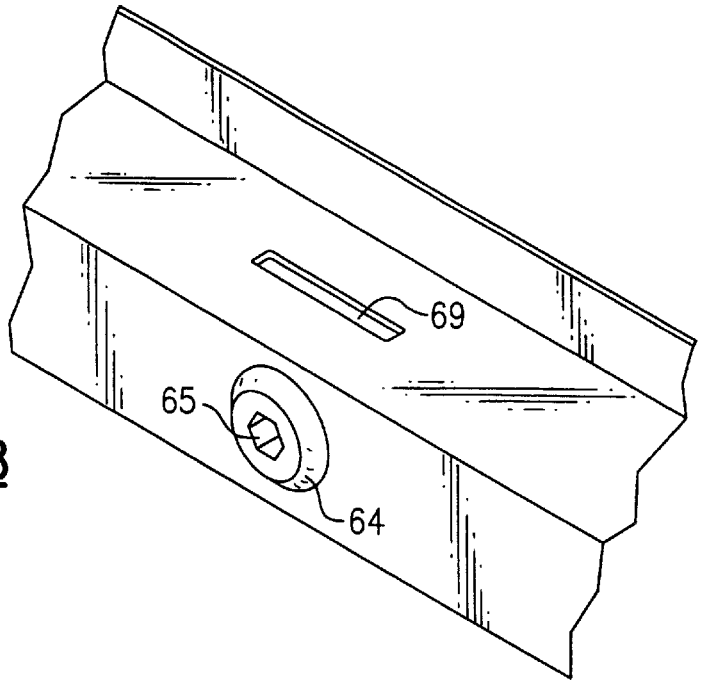
FIG. 8 shows a perspective view showing a latching mechanism for locking a panel to the duct work skeleton with the mechanism in a retracted position.
Figure 9:
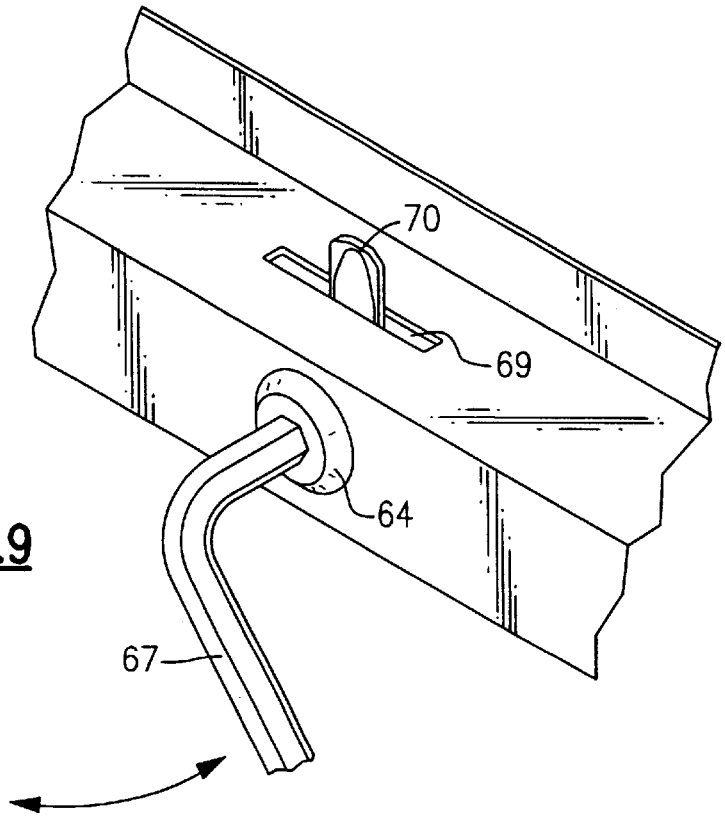
FIG. 9 shows a view similar to FIG. 8 showing the latching mechanism in a raised locking position.

Referring also to FIGS. 8–9, each latching mechanism 60 includes a cylindrical tumbler 62 that is contained within the tube. The tumbler contains an outer flange 64 that has a six sided slot 65 that passes inwardly through the flange. An Allen wrench 67 is insertable into the slot and is used to turn the tumbler between an open position and a locking position. An elongated arm 70 is secured to the tumbler that is arranged to pass upwardly through a slotted hole 69 in the containing tube as the tumbler is turned from an open position as illustrated in FIG. 8 to a locking position as illustrated in FIG. 9. Arm 70 is arranged to pass into recess 32 surrounding the panel frame and force the panel into sealing contact against the seals 50 surrounding the panel receiving opening.

Figure 10:
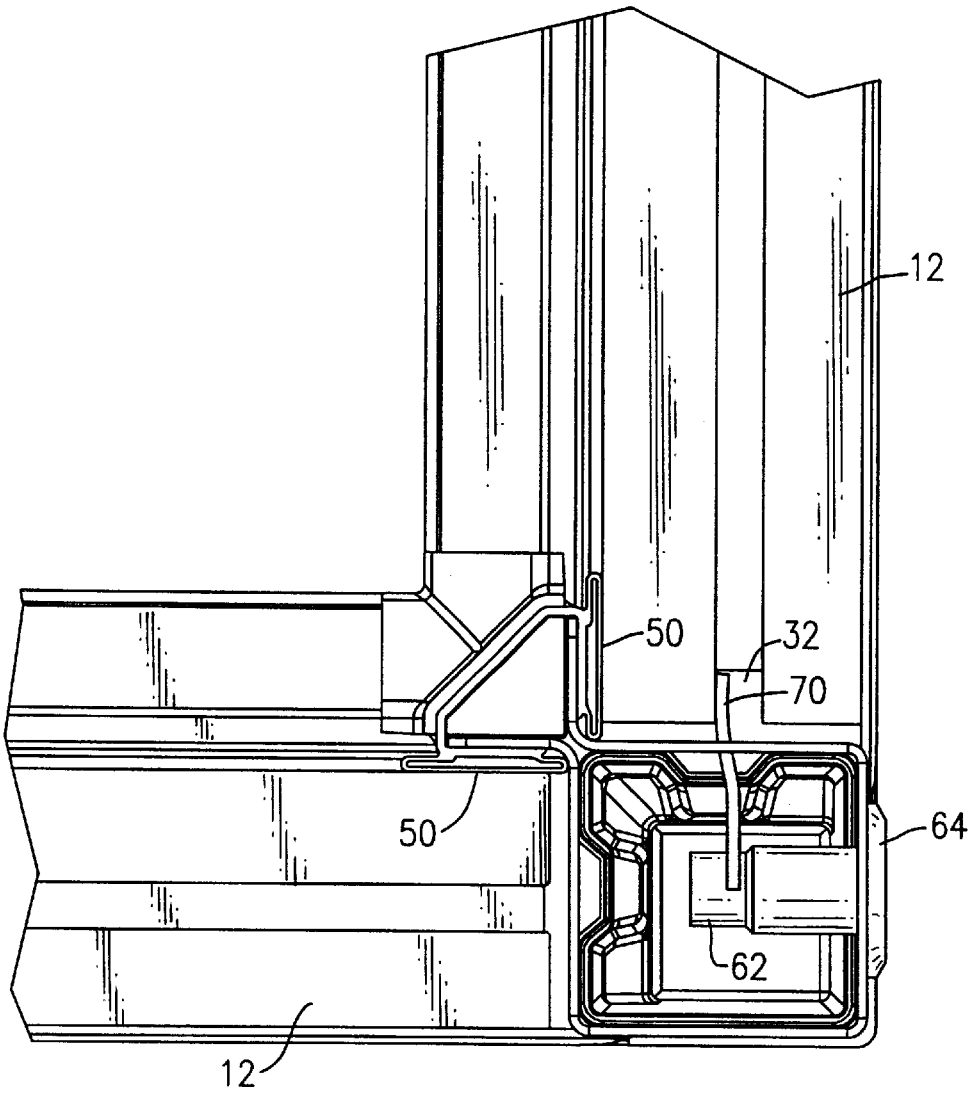
FIG. 10 shows a partial view of a section of the duct work skeleton with two sides of a panel latched to the duct work.

Referring to FIG. 10, at least one latching mechanism is preferably employed to engage each of the walls making up the panel frame 25. If one latching mechanism per side is used, it is preferably located midway along the frame section. If two latching mechanisms per side are used, each mechanism is preferably located closer to a frame corner than to the midpoint of the frame section. Latching mechanism is optionally located within corner piece 23.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. An air handling unit, comprising:

a frame structure;

at least one panel which fits into a corresponding opening in said frame structure formed by first, second, third, and fourth sides of said frame structure, wherein said first and third sides are substantially parallel and said second and fourth sides are substantially parallel;

said panel having first, second, third, and fourth edges, wherein said first and third edges are substantially parallel and said second and fourth edges are substantially parallel;

at least said first edge including a pocket formed therein;

at least said first side including a latching mechanism therein; and said latching mechanism including a rotatable cammed leg, such that when said leg is in a first position, said leg is within said first side, and when said leg is in a second position, said leg extends outside of said first side, such that when said panel is fitted into said frame structure such that said first edge of said panel is adjacent said first side of said frame structure, and said leg is in said second position, said first edge of said panel is latched to said first side of said frame structure.

2. An air handling unit according to claim 1, wherein each of said edges has a pocket formed therein.

3. An air handling unit according to claim 2, wherein each of said edges is of extruded plastic.

4. An air handling unit according to claim 1, wherein said leg is cammed.

5. An air handling unit according to claim 4, wherein at least said first side of said frame structure includes a seal, and rotating said cammed leg from said first position to said second position pushes said panel against said frame structure to compress said seal.

6. An air handling unit according to claim 5, wherein each of said edges includes a pocket formed therein, each of said sides includes a latching mechanism, and each of said sides includes a seal thereon.

7. An air handling unit, comprising:

a frame structure;

at least one panel which fits into a corresponding opening in said frame structure formed by a plurality of sides of said frame structure;

said panel having a plurality of edges corresponding to an equal number of said plurality of sides of said frame structure;

at least one of said plurality of edges including a pocket formed therein; and means for latching said at least one of said plurality of sides to said at least one edge containing said pocket, said means for latching being contained within at least one of said plurality of sides of said frame structure.

8. An air handling unit according to claim 7, wherein said at least one of said plurality of sides of said frame structure includes a seal, wherein latching said at least one of said plurality of sides to said at least one edge containing said pocket compresses said seal.

9. An air handling unit according to claim 8, wherein all of said plurality of sides of said frame structure include a seal, all of said corresponding edges of said panel include a pocket, and all of said plurality of sides of said frame structure include means for latching said corresponding edge of said panel to said corresponding side of said frame structure.

10. An air handling unit according to claim 8 wherein said seal is compressed in a direction which is parallel to said one of said plurality of sides.

* * * * *